US009611534B2

(12) United States Patent
Chavanne et al.

(10) Patent No.: US 9,611,534 B2
(45) Date of Patent: Apr. 4, 2017

(54) MOLTEN-SALT BATH FOR NITRIDING MECHANICAL PARTS MADE OF STEEL, AND IMPLEMENTATION METHOD

(75) Inventors: Herve Chavanne, Noalhat (FR); Philippe Maurin-Perrier, Saint-Marcellin-en-Forez (FR)

(73) Assignee: H.E.F., Andrezieux Boutheon (FR)

( * ) Notice: Subject to any disclaimer, the term of this patent is extended or adjusted under 35 U.S.C. 154(b) by 444 days.

(21) Appl. No.: 13/985,437

(22) PCT Filed: Mar. 7, 2012

(86) PCT No.: PCT/FR2012/050479

§ 371 (c)(1),
(2), (4) Date: Aug. 14, 2013

(87) PCT Pub. No.: WO2012/146839

PCT Pub. Date: Nov. 1, 2012

(65) Prior Publication Data

US 2013/0327445 A1 Dec. 12, 2013

(30) Foreign Application Priority Data

Mar. 11, 2011 (FR) ..... 11 52020

(51) Int. Cl.
*C23C 8/50* (2006.01)
*C23C 8/56* (2006.01)

(52) U.S. Cl.
CPC . *C23C 8/50* (2013.01); *C23C 8/56* (2013.01)

(58) Field of Classification Search
CPC ..... C23C 22/50; C23C 8/50; C23C 8/56
USPC ..... 148/228
See application file for complete search history.

(56) References Cited

U.S. PATENT DOCUMENTS

| | | | | |
|---|---|---|---|---|
| 3,905,328 | A | 9/1975 | Trattner et al. | |
| 4,019,928 | A * | 4/1977 | Beyer et al. | 148/228 |
| 4,042,427 | A * | 8/1977 | Razim et al. | 148/215 |
| 4,184,899 | A | 1/1980 | Blas et al. | |
| 4,492,604 | A | 1/1985 | Muller et al. | |
| 6,746,546 | B2 | 6/2004 | Easterday et al. | |
| 7,217,327 | B2 | 5/2007 | Eiraku et al. | |
| 2008/0099108 | A1 | 5/2008 | Baudis et al. | |
| 2013/0327604 | A1 | 12/2013 | Holly et al. | |

FOREIGN PATENT DOCUMENTS

| | | | |
|---|---|---|---|
| EP | 0 919 642 | A2 | 6/1999 |
| FR | 2 220 593 | A | 10/1974 |
| FR | 2 265 094 | A1 | 10/1975 |
| FR | 2 283 243 | A | 3/1976 |
| GB | 8 54 349 | A | 7/1959 |
| GB | 8 91 578 | A | 7/1959 |
| GB | 1 052 668 | A | 11/1965 |
| GB | 1 185 640 | A | 12/1967 |
| GB | 1 507 904 | A | 4/1978 |

OTHER PUBLICATIONS

International Search Report, dated May 7, 2012, from corresponding PCT application.

* cited by examiner

*Primary Examiner* — Humera Sheikh
*Assistant Examiner* — Lucas Wang
(74) *Attorney, Agent, or Firm* — Young & Thompson

(57) ABSTRACT

A molten-salt bath for nitriding mechanical steel parts, essentially consisting of the following (the contents being expressed in wt %): 25 to 60 wt % of alkali-metal chlorides; 10 to 40 wt % of alkali-metal carbonates; 20 to 50 wt % of alkali-metal cyanates; and a maximum of 3 wt % of cyanide ions (formed during the use of the bath), wherein the total of the contents is 100 wt %. Preferably, the bath contains: 25 to 30 wt % of sodium cyanate; 25 to 30 wt % of sodium carbonate and lithium carbonate; 40 to 50 wt % of potassium chlorides; and a maximum of 3 wt % of cyanide ions (formed during the use of the bath), the total of the contents being 100 wt %.

12 Claims, No Drawings

MOLTEN-SALT BATH FOR NITRIDING MECHANICAL PARTS MADE OF STEEL, AND IMPLEMENTATION METHOD

FIELD OF THE INVENTION

The invention relates to the nitriding of mechanical parts made of steel.

By mechanical parts is meant parts intended to ensure a mechanical function in operation, which generally means that these parts have a high degree of hardness, a good resistance to corrosion and wear; the following can thus be mentioned, in a non-limitative manner:

windscreen-wiper spindles,
hydraulic or gas cylinder rods,
combustion engine valves,
joint bushings.

The range of steels from which these parts are made, which are likely to be, at least close to their surface, subjected to friction or corrosion, is wide, ranging from non-alloy steels to so-called stainless alloys, in particular chromium or nickel alloys.

BACKGROUND OF THE INVENTION

In order to surface-harden such parts, it is known to apply a nitriding treatment (sometimes accompanied by carburizing, in which case the term "nitrocarburizing" is often used). In fact, the concept of nitriding encompasses both nitriding alone, in a bath with a very low cyanide content (typically less than 0.5%), as well as nitrocarburizing in the case of cyanide contents above this threshold. The term "nitriding" will be used for both these types of treatment hereafter.

This nitriding can be carried out from a gas phase or a plasma phase or from a liquid phase.

Liquid phase nitriding has the advantage of allowing significant hardening over a thickness of several microns within a period of just a few hours, but has the significant drawback of involving the use of molten salt baths, at temperatures of the order of 600° C. (or even more), in practice containing cyanides, in combination with cyanates and carbonates (the cations are in practice cations of alkali metals, such as lithium, sodium, potassium, etc.). In practice the cyanates decompose to form in particular cyanides, carbonates and nitrogen which is thus available to diffuse into the part to be nitrided. Due to the consumption of cyanates and enrichment with carbonates, regeneration of the baths must be provided by introducing additives making it possible to return their cyanide and cyanate contents to ranges guaranteeing their effectiveness. Hereafter, the contents of the baths are expressed in percentages by weight.

As is well known, the use of cyanides is dangerous to operatives as well as to the environment, such that for decades it has been sought to minimize the quantity of cyanides to be used in the processes for nitriding mechanical parts made of steel in molten salt baths.

Thus, in 1974-75, it was proposed to seek to minimize the cyanide content of nitriding baths, in particular by avoiding the toxic products at the time of the regeneration, (FR-2 220 593 and FR-2 283 243, or U.S. Pat. No. 4,019,928, or also GB-1 507 904); in fact these documents mentioned, without special comment, an alkaline chloride content which can range up to 30% (without however giving any example, for nitriding, comprising more than 5% by weight NaCl in a bath also containing 64% potassium cyanate, 16% potassium carbonate, 11% sodium cyanate and 4% sodium cyanides). It was considered that baths with a low cyanide content had to be essentially constituted by potassium or sodium cyanates, potassium or sodium carbonates, with more potassium than sodium (which made it possible to lower the temperature of the salt baths); the objective was to reduce the cyanide content to not more than 5%, or even 3%); the reduction in the cyanide content had to be compensated for by cyanates; there was no particular explanation of the role of the chlorides apart from the fact that, in the carburizing baths, barium chloride is a melting flux.

Previously (see the document GB-891 578 published in 1962), it had been mentioned that nitriding-carburizing baths could contain alkaline chlorides, which made it possible to economize on the cyanides and cyanates, the price of which is much higher, or to reduce the melting point; this document related to salt baths containing from 30% to 60% cyanides and taught the maximizing of the content of n-cyanates relative to the isocyanates (there were no chlorides in the example described).

There had also been mentioned (see the document GB-854 349 published in 1960), carburizing baths (used at temperatures from 800° C. to 950° C.) containing, by weight, from 35% to 82% alkali metal carbonates, from 15% to 35% alkali metal cyanides, from 3% to 15% anhydrous alkali metal silicates and up to 15% alkaline chlorides; it was indicated there that it is preferable that alkaline chlorides be present, preferably up to 10%, without however giving any explanation (it seems however that the presence of chlorides contributed to the preparation of the cyanides in a useable form). Moreover, there had been mentioned (see the document GB-1 052 668 published in 1966) carbonitriding baths, in crucibles having a composition within a well-chosen range, containing from 10 to 30% alkali metal cyanates and at least 10% alkali metal cyanides, at 600° C.-750° C.; a content of 25% alkali metal chloride was mentioned, with respect to a starting bath (moreover containing only cyanides (25%) and carbonates), as well as in the regeneration compound (containing moreover 75% cyanides). It has also been proposed (GB-1 185 640) to complete a carburizing stage with a short stage of dipping in a bath containing cyanides, cyanates, carbonates and alkali metal chlorides (without specifying ranges of contents for the latter).

For the nitriding of stainless steels, a gas phase nitriding treatment has been proposed (U.S. Pat. No. 4,184,899 published in 1980), preceded by a stage of thermochemical pretreatment in a bath containing from 4% to 30% cyanides and from 10% to 30% cyanates in combination with from 0.1% to 0.5% sulphur. It is mentioned that the remainder of the pretreatment baths can be formed by sodium carbonate or chloride, without these elements being active in the treatment (with respect to a bath with 12% cyanides and 0.3% sulphur, it is mentioned that at the start there is 25% sodium carbonate and 42.7% sodium chloride).

More recently, (see in particular the document U.S. Pat. No. 4,492,604 published in 1985) a nitriding bath has been proposed the cyanide content of which is comprised between 0.01% and 3%. It is indicated that, due to the strong reducing action of cyanides in nitriding baths at approximately 550° C.-650° C., whereas cyanates have a tendency to release oxygen, nitriding baths with a low cyanide content have a tendency to oxidize the nitriding layers and give rise to unacceptable coatings. In order to prevent the formation of such defects, it is taught to include up to 100 ppm of selenium, in combination with an appropriate composition of the crucibles (without iron).

It has also been proposed to harden ferrous parts using a bath containing high chloride levels (see the document EP-0 919 642 published in 1999), but this bath in fact serves to complete a nitriding action, being intended to allow the introduction of chromium (present in this bath in addition to the chlorides, with silica) into a previously formed nitriding layer.

For nitriding ferrous parts, a molten-salt bath has been proposed by the document U.S. Pat. No. 6,746,546 (published in 2004), containing alkali metal cyanates and alkali metal carbonates, with 45% to 53% cyanate ions (preferably between 48% and 50%), maintained between 750° F. and 950° F., i.e. between 400° C. and 510° C., in order to provide good corrosion resistance. The alkali metals were advantageously sodium and/or potassium (when both were present, the potassium content was preferably 3.9:1 relative to the sodium content); in operation, this bath contained from 1% to 4% cyanides (no details were given concerning the presence of any other elements in the bath).

Even more recently, in order to minimize the entrainment of the molten salts when the nitrided ferrous parts are taken out, the document U.S. Pat. No. 7,217,327 proposed a nitriding bath essentially constituted by Li-, Na- and K-type cations and by carbonate and cyanate anions.

It therefore appears that various compositions of molten salt baths have been proposed in order to allow nitriding of ferrous parts without using significant cyanide contents.

However, as a general rule, nitriding treatments with a low cyanide content (typically less than 3%,) must be followed by a finishing treatment because a low roughness is sought, which contributes to an increase in the cost of treatment (labour, grinding equipment) as well as the overall duration of treatment.

A low roughness can be obtained with nitriding baths with a high cyanide content (more than 5%), but after periods of several hours (typically 4 to 6 hours), which can appear too long on an industrial scale.

SUMMARY OF THE INVENTION

A subject of the invention is a nitriding bath with a low cyanide content capable, in a maximum of the order of a few hours, of nitriding mechanical parts made of iron or steel while conferring upon them a very low roughness (therefore without significant porosity), making subsequent mechanical refinishing (by grinding or tribofinishing) unnecessary, all for a moderate cost.

For this purpose the invention proposes a nitriding bath essentially constituted by (the contents are expressed by weight):

- from 25% to 60% alkali metal chlorides,
- from 10% to 40% alkali metal carbonates, and
- from 20% to 50% alkali metal cyanates,
- a maximum of 3% cyanide ions (formed during operation), the total of the contents being 100%.

It should be noted that the composition ranges are generally given for a new bath, but that it is sought in practice to remain so far as possible within these ranges; thus, in practice there is no cyanide ion in the starting bath, and it is sought during operation to remain at no more than 3% cyanide ions.

DETAILED DESCRIPTION OF THE INVENTION

The presence according to the invention of chlorine-containing compounds in significant quantities (NaCl, KCl, LiCl, etc.) makes it possible, during the nitriding, to obtain non-porous, non-powdery and therefore fairly smooth layers, after durations of treatment of the order of just two hours; as the chlorides are less expensive than the other usual components of the nitriding baths, a bath according to the invention is therefore more economical than a standard bath, while avoiding the need for subsequent grinding treatment. It may be recalled that treatment times of the order of two hours (2 h+/−5 min) maximum are considered compatible with satisfactory yields on an industrial scale.

It may be noted that, in the baths used in the past, it had already been proposed to combine cyanates and carbonates with chlorides in nitriding baths, including when they are substantially devoid of cyanides, but the chlorides (for which no role was recognized in the nitriding) did not appear in practice in contents greater than 10-15% in the absence of cyanides (or with low cyanide ion contents, typically less than or equal to 3%). Moreover, no document had suggested the least correlation between the presence of chlorides and the final roughness.

Advantageously, the alkali metal chlorides are lithium, sodium and/or potassium chlorides, corresponding to chlorides which have proved effective, while having a moderate cost and requiring no serious handling constraints.

Advantageously, the chloride content is comprised between 40% and 50%, preferably at least approximately equal to 45% (+/−2%, or even +/−1%). This range of contents has proved to lead to good nitriding and low roughness within a reasonable time.

It is understood that:

- the cyanate content must be sufficient to allow a nitriding effect,
- the carbonate content should not become too great at the risk of preventing the chemical reactions that lead to nitriding.

Thus, equally advantageously, the cyanate content is comprised between 20% and 40%, or even between 20% and 35%, preferably comprised between 20% and 30%. Even more advantageously, this content is comprised between 25% and 40%, or even between 25% and 35%, preferably comprised between 25% and 30%. These cyanates can in particular be sodium cyanates (or potassium cyanates).

Equally advantageously, the alkali metal carbonate content is from 20% to 30%, preferably comprised between 25% and 30%. These carbonates can in particular be sodium, potassium and/or lithium carbonates; they can advantageously be a mixture of sodium and lithium carbonates.

Thus, particularly advantageously, the molten-salt bath is essentially constituted by (to within +/−2%, or even +/−1%):

- 25% to 30% sodium cyanate,
- 25% to 30% sodium and lithium carbonates,
- 40% to 50% potassium chlorides,
- a maximum of 3% cyanide ions (formed during operation), the total of these contents being 100%.

Preferably, the molten-salt bath is essentially constituted, before the formation of cyanides up to a maximum of 3%, by (to within +/−2%, or even +/−1%):

- 28% sodium cyanate,
- 22% sodium carbonate,
- 5% lithium carbonate,
- 45% potassium chloride, which has proved to be a very good compromise between the nitriding kinetics, price of the mixture constituting the bath, variations in roughness on the surface of the treated parts, melting point, and risk of entrainment of the salts on the surface of the treated parts. Of course, in operation this composition can vary slightly, given the reactions which take place (with in particular the formation of cyanide ions the content of which is maintained at a maximum of 3%).

The invention also proposes a process for nitriding mechanical parts made of iron or steel, according to which these parts are immersed in a bath with the abovementioned composition, at a temperature comprised between 530° C. and 650° C. for a maximum of 4 h.

Preferably, the parts are immersed in the bath at a temperature comprised between 570° C. and 590° C. for a maximum of 2 h.

In practice, the duration of a nitriding treatment is in a standard fashion of the order of 90 minutes, but it is understood that the duration of treatment depends on the nature and/or destination of the parts; thus it can range from some 30 minutes for valves or steels for tools, up to 4 h when it is sought to carry out nitriding over significant thicknesses (layers with thicknesses of several tens of micrometers), or in the case of alloy steels. However, the invention is advantageously implemented with treatment times of the order of 60 to 120 minutes.

The invention also relates to mechanical parts made of iron or steel nitrided according to the abovementioned process, which can be recognized in particular by the absence of traces of subsequent mechanical finishing processes such as grinding (in particular the absence of fine scratches due to grinding).

Hereafter, the tested compositions are compared with standard baths (which are the same for the different examples) which are not in accordance with the invention.

EXAMPLE 1

According to the Invention

Samples made of a type C45 annealed steel, which can be used for windscreen-wiper spindles, hydraulic or gas cylinder rods, or joint bushings were treated as follows.

These samples were subjected to degreasing in an alkaline solution, rinsing in water then preheating to 350° C.

They were then immersed, for 60 minutes, in a molten-salt bath maintained at 580° C. and containing:

28% sodium cyanate,
22% sodium carbonate, and
45% potassium chlorides
5% lithium carbonate.

The samples thus nitrided were then rinsed with water.

Identical samples were subjected to the same treatment, except that the nitriding treatment of 60 minutes at 580° C. was carried out in a standard nitriding bath (not according to the invention) essentially constituted by:

58% sodium cyanate,
36% potassium carbonate, and
6% lithium carbonate

In both cases, the layer of iron nitrides thus formed had a thickness of 10+/−1 μm.

It was found that the roughness of the samples which was initially Ra=0.2 micrometers, had become Ra=0.52 micrometers after the treatment in a standard bath but Ra=0.25 micrometers after the treatment in the bath according to the invention, i.e. a roughness slightly greater than the initial roughness.

The composition according to the invention of this example appeared to promote good stability of the bath over time, in particular as regards the level of cyanides.

The samples thus nitrided were then oxidized in a molten-salt bath containing carbonates, hydroxides and nitrates of alkali metals. The purpose of this oxidation was to passivate the surface of the nitride layer by forming a layer of iron oxide with a thickness from 1 to 3 μm. After oxidation, the parts were immersed in an oil providing protection against corrosion (containing corrosion inhibitors) as is customary with nitriding processes.

The corrosion resistance (measured on 10 parts in neutral salt spray according to the standard ISO 9227) of the samples treated according to the invention was comprised between 150 and 250 hours.

The corrosion resistance (measured on 10 parts in neutral salt spray according to the standard ISO 9227) of the samples treated in the standard bath was comprised between 120 and 290 hours.

Nitriding of ferrous parts carried out according to the invention therefore makes it possible to obtain a corrosion resistance comparable to that obtained with nitriding in a standard bath, while improving the roughness of the surfaces, relative to a treatment in such a standard bath.

EXAMPLE 2

Not According to the Invention

Samples of annealed C45 steel, prepared as previously, were nitrided for 1 hour at 590° C. in a bath containing:

20% alkali metal chlorides (NaCl, KCl)
40% sodium cyanate
30% potassium carbonate
10% lithium carbonate In both cases, the layer formed has a thickness of 10+/−1 μm.

It was found that the roughness of the samples which was initially Ra=0.2 micrometers, had become Ra=0.48 micrometers after treatment in this bath compared with Ra=0.52 micrometers after treatment in a standard bath.

This leads to the conclusion that too low a chloride content does not make it possible to significantly reduce the final roughness of the parts relative to a standard bath (not according to the invention).

EXAMPLE 3

Not According to the Invention

A bath was prepared, containing

65% sodium chloride
25% potassium cyanate
10% potassium carbonate.

Such a bath proved to be unusable industrially since its melting point is above 600° C., which prevents any nitriding treatment in ferritic phase to be carried out (the majority of the parts are generally nitrided in ferritic phase, i.e. at a temperature below 600° C.). Only nitriding in austenitic phase can then be envisaged, but only for temperatures above 630° C. and with a high level of salt entrainment (high viscosity of the bath), which is economically disadvantageous.

EXAMPLE 4

According to the Invention

The treatment of annealed C45 samples, under conditions similar to those of Example 1, but in a bath containing 35% sodium cyanate
20% sodium carbonate
20% potassium carbonate
25% potassium chloride made it possible to obtain a final roughness of Ra=0.28 μm as against Ra=0.52 μm in a standard bath (not according to the invention), on the surface of nitriding layers of 10+/−1 micrometer.

Although satisfactory as regards roughness, this composition appeared to have a higher viscosity than the composition of Example 1, which results in a greater consumption of salts.

The level of porosity of the nitride layers obtained according to the invention is less than 5%, whereas the level of porosity of the nitride layers obtained with a standard bath is comprised between 25 and 35%.

EXAMPLE 5

Not According to the Invention

A bath was prepared containing
45% potassium chloride
10% sodium cyanate
45% sodium carbonate.

Such a bath proved unusable for nitriding treatment since its liquidus temperature is above 600° C. It is recalled that the liquidus temperature is the temperature starting from which the bath is completely molten and homogeneous in composition (unlike the melting point which is the temperature starting from which the bath begins to be liquid, possibly in several phases).

As explained in Example 3, such a bath cannot be advantageously used industrially because it makes any ferritic-phase treatment impossible and entrainments of salts between 600 and 650° C. are very significant.

EXAMPLE 6

According to the Invention

The treatment of annealed C45 samples, under conditions similar to those of Example 1, but in a bath containing:
45% potassium chloride
30% sodium cyanate
25% sodium carbonate
makes it possible to obtain, as in Example 1, a final roughness of Ra=0.25 μm slightly above the initial roughness of Ra=0.2 μm, as against Ra=0.52 μm in a standard bath (not according to the invention).

The layer of iron nitride formed in the bath according to the invention is of types ϵ ($Fe_{2-3}N$) and has a level of porosity of less than 5% (measured by optical microscopy) and has a hardness of 840±40 $HV_{0.01}$.

The layer of iron nitride formed in the standard bath (not according to the invention) is of types ϵ ($Fe_{2-3}N$) and has a level of porosity comprised between 25 and 35% (measured by optical microscopy) and has a hardness of 700±40 $HV_{0.01}$. A lower degree of apparent hardness of the layers obtained with a standard bath is explained by their higher level of porosity. In fact, it is well known that the presence of porosity (i.e. holes) reduces the resistance of the layers to the penetration by the indenter for measuring hardness.

In both cases, the layer formed has a thickness of 10+/−1 μm.

EXAMPLE 7

According to the Invention

Samples made of C45 machined by cold heading then subjected to high-frequency dipping with an initial roughness of Ra=0.74 μm were nitrided (after a preparation similar to that of Example 1) for two hours at 590° C. in a bath identical to that of Example 1, containing:
28% sodium cyanate
22% sodium carbonate
45% potassium chloride
5% lithium carbonate A layer of 20+/−1 μm was formed with a final roughness of Ra=0.79 μm. For comparison, identical samples which were treated for the same duration, two hours, in a standard bath (not according to the invention) have a layer with a final roughness of Ra=1.23 μm for a layer with a thickness of 17 +/−1 μm.

The level of porosity of the nitride layers obtained according to the invention is comprised between 5 and 10%, whereas the level of porosity of the nitride layers obtained with a standard bath is comprised between 55 and 65%. It is known that the steels which have been subjected to cold heading have a high level of strain hardening which has a detrimental effect on the porosity of the layers (the higher the level of strain hardening, the more porous the layers). The invention makes it possible to obtain layers with a low level of porosity, even for highly strain-hardened steels.

The samples thus nitrided were then oxidized in a molten-salt bath containing carbonates, hydroxides and nitrates of alkali metals. The purpose of this oxidation is to passivate the surface of the nitride layer by forming a layer of iron oxide with a thickness of 1 to 3 μm. After oxidation, the parts are immersed in an oil providing protection against corrosion (containing corrosion inhibitors) as is customary with the nitriding processes.

The corrosion resistance (measured on 10 parts in neutral salt spray according to the standard ISO 9227) of the samples treated according to the invention is comprised between 310 and 650 hours.

The corrosion resistance (measured on 10 parts in neutral salt spray according to the standard ISO 9227) of the samples treated in a standard bath is comprised between 240 and 650 hours.

EXAMPLE 8

According to the Invention

Samples made of 42CrMo4 quenched and tempered then ground with an initial roughness of Ra=0.34 μm were nitrided (after a preparation similar to that of Example 1) in the same way as those of Example 7, i.e. for two hours at 590° C. in a bath identical to that of Example 1, containing:
28% sodium cyanate
22% sodium carbonate
45% potassium chloride
5% lithium carbonate A layer of iron nitride of 16+/−1 μm was formed with a final roughness of Ra=0.44 μm. For comparison, identical samples which were treated for two hours in a standard bath (not according to the invention) have a layer of iron nitrides with a final roughness of Ra=0.85 μm in the case of a layer with a thickness of 14+/−1 μm.

The layer of iron nitride formed in the bath according to the invention is of types ϵ ($Fe_{2-3}N$) and has a level of porosity less than 5% (measured by optical microscopy) and has a hardness of 1020±40 $HV_{0.01}$.

The layer of iron nitride formed in the standard bath is of type ϵ ($Fe_{2-3}N$) and has a level of porosity comprised between 30 and 40% (measured by optical microscopy) and has a hardness of 830±40 $HV_{0.01}$. A lower level of apparent hardness of the layers obtained with a standard bath is explained by their higher level of porosity. In fact, it is well known that the presence of porosity (i.e. holes) reduces the resistance of the layers to penetration by the indenter used for measuring hardness.

EXAMPLE 9

According to the Invention

Annealed C45 samples with an initial roughness of Ra=0.20 μm were prepared and nitrided as in Example 1, i.e. for 1 hour at 580° C. in a bath containing:

28% sodium cyanate
22% sodium carbonate
45% potassium chloride
5% lithium carbonate A layer of 10+/−1 μm was formed with a final roughness of Ra=0.25 μm. For comparison, identical samples which were treated for three hours in a standard bath operating with a high level of cyanides (5.2%) have a layer with a final roughness of Ra=0.27 μm in the case of a layer with a thickness of 7+/−1 μm.

It therefore appears that with an equivalent final roughness, although the treatment time is longer, the thickness of the layers obtained in a standard bath with a high level of cyanide is less than the thickness of the layers obtained in a bath according to the invention. This is explained by the fact that, in addition to being more polluting, a bath with a high cyanide content is also carburizing, i.e. carbon will diffuse jointly with nitrogen into the steel. The carbon and the nitrogen are in competition during the diffusion since they occupy the same sites in the iron crystal lattice. The presence of carbon will therefore limit the diffusion of the nitrogen, which will result in less thick layers.

As indicated above, the compositions indicated in the abovementioned examples define the new bath, it being stipulated that the indications of contents for the cyanide ions apply in operation, taking account of the reactions involved in the nitriding (it is then sought to keep the composition of the bath as stable as possible).

The invention claimed is:

1. Molten-salt bath for nitriding mechanical parts made of steel, consisting essentially of by weight:

40% to 60% alkali metal chlorides selected from the group consisting of lithium, sodium and potassium chlorides,
10% to 40% alkali metal carbonates,
20% to 40% alkali metal cyanates, and
a maximum of 3% cyanide ions.

2. The molten-salt bath according to claim 1, wherein the content of alkali metal chloride is between 40% and 50%.

3. The molten-salt bath according to claim 1, wherein the content of alkali metal chloride is 43-47%.

4. The molten-salt bath according to claim 1, wherein the content of alkali metal cyanate is between 20% and 30%.

5. The molten-salt bath according to claim 1, wherein the content of alkali metal cyanate is between 25% and 30%.

6. The molten-salt bath according to claim 1, wherein the content of alkali metal carbonate is between 20% and 30%.

7. The molten-salt bath according to claim 1, wherein the content of alkali metal carbonate is between 25% and 30%.

8. The molten-salt bath according to claim 1, consisting essentially of:

25% to 30% sodium cyanate,
25% to 30% sodium and lithium carbonates,
40% to 50% potassium chlorides, and
a maximum of 3% cyanide ions.

9. The molten-salt bath according to claim 8, consisting essentially of, before formation of cyanide ions up to a maximum of 3%:

28% sodium cyanate,
22% sodium carbonate,
5% lithium carbonate, and
45% potassium chloride.

10. Process for nitriding mechanical parts made of iron or steel, comprising immersing said parts in the molten-salt bath of claim 1, at a temperature between 530° C. and 650° C. for a maximum of 4 h.

11. The process according to claim 10, wherein the parts are immersed in the molten-salt bath at a temperature between 570° C. and 590° C. for a maximum of 2 h.

12. Mechanical part made of nitrided steel obtained by the process according to claim 10, not exhibiting any trace of a subsequent mechanical finishing process.

* * * * *